US009597729B2

(12) United States Patent
Goettsch et al.

(10) Patent No.: US 9,597,729 B2
(45) Date of Patent: Mar. 21, 2017

(54) METAL POURING METHOD FOR THE DIE CASTING PROCESS

(71) Applicant: GM Global Technology Operations LLC, Detroit, MI (US)

(72) Inventors: David D. Goettsch, Shelby Township, MI (US); Brad A. Ohlrich, Bloomington, IN (US); Jason R. Traub, Clinton Township, MI (US); Michael J. Walker, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 203 days.

(21) Appl. No.: 14/613,991

(22) Filed: Feb. 4, 2015

(65) Prior Publication Data

US 2016/0221079 A1 Aug. 4, 2016

(51) Int. Cl.

| | |
|---|---|
| ***B22D 17/28*** | (2006.01) |
| ***B22D 17/30*** | (2006.01) |
| ***B22D 43/00*** | (2006.01) |
| ***B22D 35/04*** | (2006.01) |

(52) U.S. Cl.

CPC ..... *B22D 35/04* (2013.01); *B22D 17/28* (2013.01); *B22D 17/30* (2013.01); *B22D 43/004* (2013.01)

(58) Field of Classification Search

CPC ..... B22D 41/50; B22D 17/28; B22D 17/30; B22D 43/004; B22C 9/086

USPC ..... 164/113, 134, 303–318, 335, 358; 222/591–607

See application file for complete search history.

(56) References Cited

U.S. PATENT DOCUMENTS

| | | | | |
|---|---|---|---|---|
| 3,893,917 | A | 7/1975 | Pryor et al. | |
| 3,962,081 | A | 6/1976 | Yarwood et al. | |
| 4,056,586 | A | 11/1977 | Pryor et al. | |
| 4,798,615 | A * | 1/1989 | Fukuta | B01D 39/086 164/358 |
| 5,921,311 | A * | 7/1999 | Menendez | B22D 41/05 164/335 |
| 5,961,918 | A * | 10/1999 | Day | B01D 39/2075 210/510.1 |
| 5,979,534 | A * | 11/1999 | Shibata | B22D 17/007 164/113 |
| 8,496,045 | B2 * | 7/2013 | Kikuchi | B22D 39/026 164/113 |
| 8,522,857 | B2 | 9/2013 | Goettsch et al. | |

FOREIGN PATENT DOCUMENTS

| | | | | |
|---|---|---|---|---|
| DE | 102009057184 A1 * | 6/2011 | | B22D 41/04 |

* cited by examiner

*Primary Examiner* — Kevin E Yoon

(57) ABSTRACT

A method of transferring molten metal to a die casting mold is disclosed. The method includes providing a ladle with a dip well and a dispensing nozzle having a fluid metal filter formed therein as well as providing a receptacle fluidly between the ladle and the mold. Further the method includes delivering the molten metal from the ladle to the receptacle by positioning an exit face of the dispensing nozzle over the receptacle and rotating the ladle such that the exit face of the dispensing nozzle is repositioned proximal the bottom of the receptacle and conveying the molten metal that has been delivered to the receptacle into a mold cavity that is placed in fluid communication therewith.

19 Claims, 3 Drawing Sheets

METAL POURING METHOD FOR THE DIE CASTING PROCESS

BACKGROUND TO THE INVENTION

This invention relates generally to an improved way to pour molten metal used in a casting operation, and more particularly to minimize the metal damage due to filling of shot sleeve of a horizontal high pressure die casting machine by using bottom filling of the shot sleeve and removal of inclusions present from the dip well.

Low process cost, close dimensional tolerances (near-net-shape) and smooth surface finishes are all desirable attributes that make high pressure die casting (HPDC) a widely used process for the mass production of metal components. By way of example, manufacturers in the automobile industry use HPDC to produce near-net-shape aluminum alloy castings for engine, transmission and structural components. In a typical HPDC process, molten metal is introduced into shaped mold cavities through two metal transfer steps: a (first) low pressure tilt pour from a ladle to a filler tube (called a shot sleeve), and a (second) high pressure injection (such as upon movement of a piston in the tube) into the gating/casting cavity.

The pouring of a molten material, such as metal, for example, into a casting mold is a significant process variable that influences the internal soundness, surface conditions, and mechanical properties, such as tensile strength, porosity, percent elongation and hardness, of a cast object. Many different designs for dipping/pouring ladles exist and are used in the foundry industry. The designs are normally chosen based upon the type of molten metal and casting mold used. Commonly used ladles make use of a slot, a lip and a baffle, or a dam at the top of the ladle to reduce inclusion of furnace metal oxides during metal filling, or the ladle may incorporate a stopper rod to control the flow of metal into and out of the ladle.

Aluminum alloy castings are sensitive to molten metal delivery speed. Molten metals such as aluminum, for example, react with the air and create oxides, commonly known as dross, which upon mixing with the rest of the molten metal creates inclusions and highly porous regions in the cast object during solidification of the metal. When the delivery speed is too low, misruns and cold shuts may result; when it is too high, turbulent flow can entrap air or other gases that can in turn lead to oxide formations, as well as form surface molten aluminum that oxidizes when it comes in contact with ambient air. While many factors influence and account for undesirable properties in the cast object, two common sources of inclusions include formation of a dross layer on top of the molten metal, and the folding action of the molten metal caused by turbulent flow of the molten metal during pouring. Turbulent metal flow exposes the molten metal surface area to the air which creates the dross layer. Depending on the velocity of the molten metal, dictated by the pouring ladle and shot sleeve design and use, the molten metal may fold-over itself many times, thereby trapping oxygen and metal oxide layers therein and exposing additional surface area of the metal to the air.

The concern over higher speed HPDC operations—while more efficient for large-scale production than their low-speed counterparts—is particularly acute considering that the high velocities are an inherent part of the higher delivery pressures. Both the entrapped (i.e., bi-film) and surface (i.e., top-layer) dross mix and subsequently solidify with the rest of the molten metal, which in turn leads to inclusions and highly porous regions that adversely impact structural and mechanical properties of the cast component.

Research has shown that the entrained air (i.e., bi-film) variant of dross can arise if the velocity of the liquid metal is sufficiently high, and that such a velocity is believed to be between 0.45 m/s and 0.5 m/s for Al, Mg, Ti and Fe alloys. See, for example, Campbell, *Castings* (Elsevier Butterworth-Heinemann, 2003). Thus, it is desirable to keep metal delivery speeds under this critical velocity to significantly reduce the number of oxides being formed in the casting. Maintaining a low metal velocity below the critical velocity is not achievable in a standard tilt pour filling operation of a horizontal shot sleeve because of the required height in which it is poured. The typical free fall velocity of the aluminum alloy stream reaches over 2.5 m/s, five times higher than the recommended velocity. This metal damage is additive to the damage done during the high pressure injection phase.

Typical foundry ladles are referred to as tilt-pour ladles. These ladles are substantially cylindrical in shape with an external spout extending outwardly from the top thereof. The molten metal is typically transferred from the ladle to a casting mold through a pour basin. Turbulence of the molten metal also results when the molten metal is poured through the air and into the pour basin. One method of eliminating this turbulence is described in U.S. Pat. No. 8,522,857 for "Ladle for Molten Metal." A ladle couples to the mold gating system and rotates to raise the metal above the junction. Two mold pieces are used to form the sprue and coupling orifice. This technology eliminates the need for a pour basin and the free falling metal stream. Its implementation to the filling of a horizontal shot sleeve is deterred by its one piece construction and lack of accessible parting lines.

Porous ceramic foam materials have been used in metal melting furnaces and gravity pour gating systems. Filter efficiency in cleaning molten metal is described in U.S. Pat. No. 3,893,917 for "Molten Metal Filter", U.S. Pat. No. 3,962,081 for "Ceramic Foam Filter", and U.S. Pat. No. 4,056,506 for "Method of Preparing Molten Metal Filter". The addition of filters in low pressure and gravity pour casting molds has been successfully implemented. Mold and core prints allow a filter to be seated in the metal flow path close to the casting cavity, reducing the metal velocity and capturing inclusions. However, there is no feature similar to the mold and core prints which allow a filter to be seated in the metal flow path in a horizontal shot sleeve.

There is a continuing need for a production viable method of transferring molten metal from the ladle to a horizontal die casting shot sleeve which minimizes turbulence in the molten metal and militate against inclusions in a cast component.

SUMMARY OF THE INVENTION

It is against the above background that embodiments of the present invention generally relate to methods to reduce the air entrainment and oxide film inclusions due to the gravity filling of a horizontal die casting shot sleeve. According to a first aspect of the present invention, a method of transferring molten metal to a die casting mold includes providing a ladle with a dip well and a dispensing nozzle formed therein as well as providing a receptacle fluidly between the ladle and the mold. The method also includes delivering the molten metal from the ladle to the receptacle by positioning an exit face of the dispensing nozzle over the receptacle and rotating the ladle such that the exit face of the dispensing nozzle is repositioned proximal the bottom of the receptacle. Additionally, the method includes conveying the molten metal that has been delivered to the receptacle into a mold cavity that is placed in fluid communication therewith. Further, the dispensing nozzle includes a fluid metal filter formed therein.

According to another aspect of the present invention, a method of transferring molten metal to a die casting mold includes providing a ladle with a dip well and a dispensing nozzle receptor formed on opposite sides of the ladle. The method further includes affixing the dispensing nozzle to the dispensing nozzle receptor. Further, the method includes providing a horizontal shot sleeve fluidly between the ladle and the mold. The method additionally includes collecting the molten metal in the ladle and delivering the molten metal from the ladle to the horizontal shot sleeve by positioning an exit face of the dispensing nozzle over the horizontal shot sleeve and rotating the ladle such that the exit face of the dispensing nozzle is repositioned proximal the bottom of the horizontal shot sleeve. Further, the method includes conveying the molten metal that has been delivered to the horizontal shot sleeve into a mold cavity that is placed in fluid communication therewith. Additionally, the dispensing nozzle includes a fluid metal filter formed therein.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
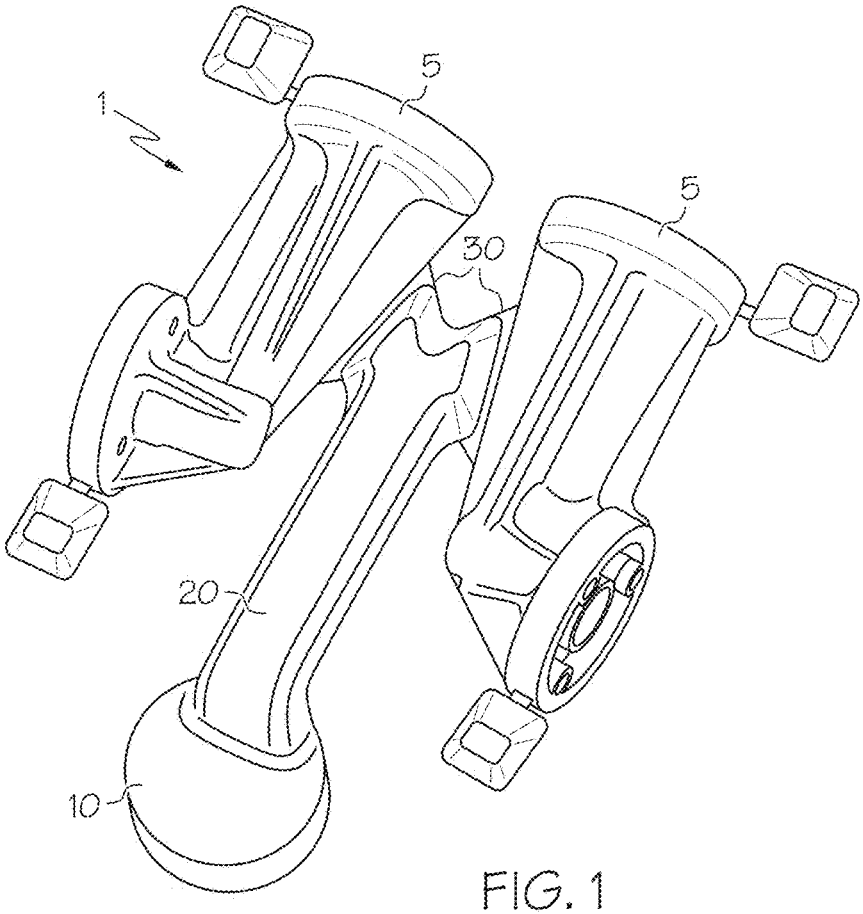
FIG. 1 (PRIOR ART)
FIG. 1 is a simplified view of a gating system according to the prior art.

Referring first to FIG. 1, in one form of HPDC, a network of fluidly connected channels may be used to convey the molten material to the mold cavities; such a network is commonly referred to as a gating (or charging) system 1. In the figure, the notional component that corresponds to the depicted shot design being produced is a two-cavity automotive oil filter adapter 5, although it will be appreciated by those skilled in the art that any other component compatible with HPDC manufacturing could also be shown without detracting from the nature of the present invention. Among other components, the gating system 1 may include the end of the shot sleeve biscuit 10, a runner 20 and casting cavity gates 30.

Figure 2:
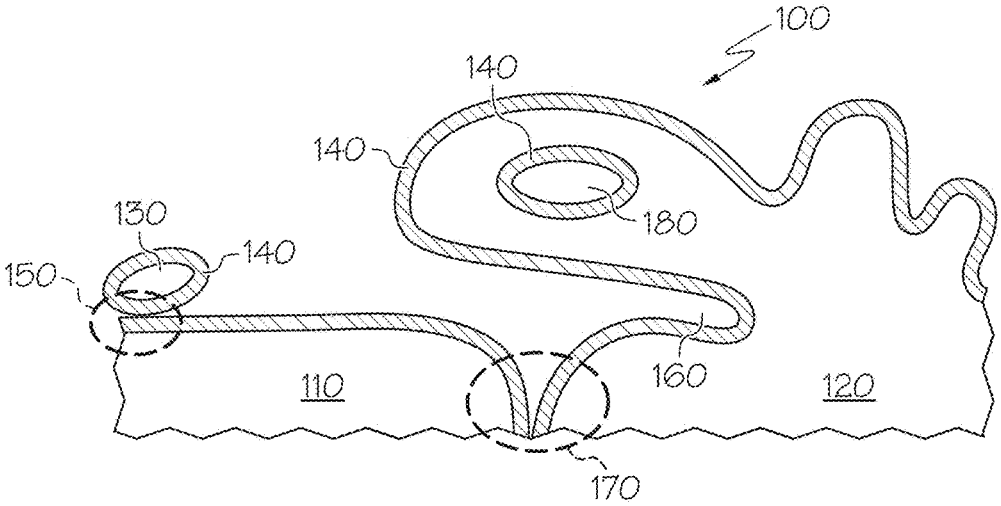
FIG. 2 (PRIOR ART)
FIG. 2 shows a representative bi-film produced by turbulence of the prior art.

Referring next to FIG. 2, multiple forms of defects in an aluminum alloy are shown. Upon heating into liquid (i.e., molten) form 100, various streams of aluminum (for example, first stream 110 and second stream 120, as well as droplets 130) interact in varied ways. When processed in an oxygen-containing environment, oxide films 140 may form on the outer surface of the liquid aluminum, including the first stream 110, second stream 120 and droplets 130. A bi-film 170 forms when the two oxide films 140 from respective first stream 110 and second stream 120 meet. Bi-films also form when turbulence-induced droplets land on the metal stream, as shown at 150. While bi-films 150, 170 are an inherent part of almost every casting process, they are generally not detrimental to casting mechanical properties unless the oxide film 140 is entrained in the bulk of the alloy, as shown at location 160 due to the folding action when two separate streams, first stream 110 and second stream 120, meet at large angles (typically more than 135 degrees, where the splashing action of one stream collapses onto another stream to form a cavity therebetween). Such a formation can have significant impacts on overall material integrity and subsequent casting scrap rates. Likewise, entrained gas 180 may form from the pouring action of liquid metal, creating additional entrained oxides. As mentioned above, when liquid metal is poured or forced into a mold or shot sleeve in a conventional manner, it is possible to trap large gas bubbles.

Figure 3:
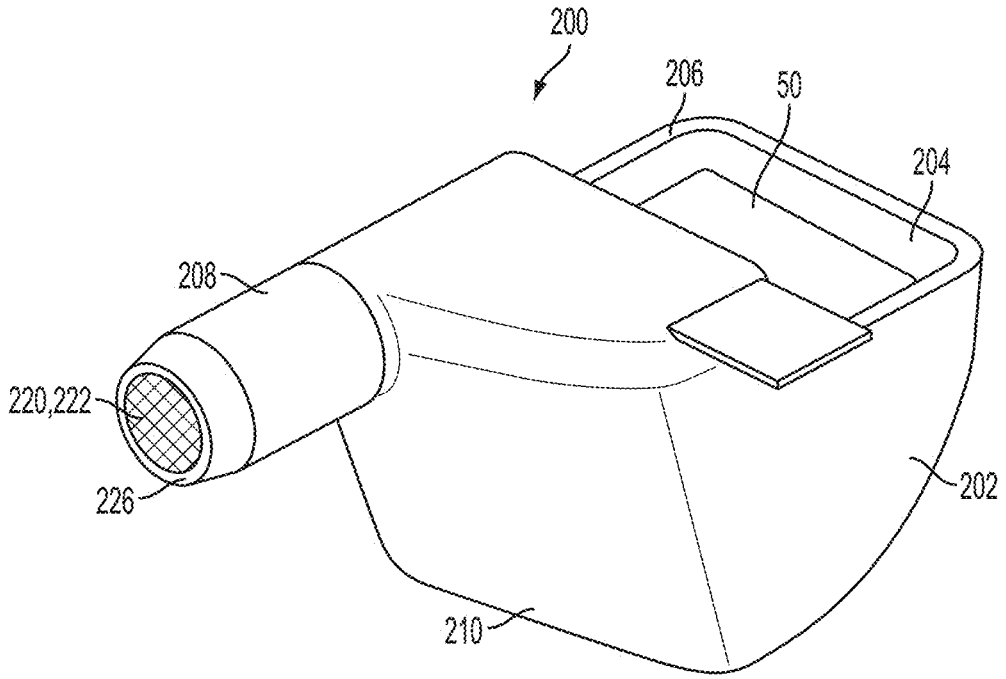
FIG. 3 shows a perspective view of a ladle comprising a screen according to an aspect of the present invention.
Figure 4:
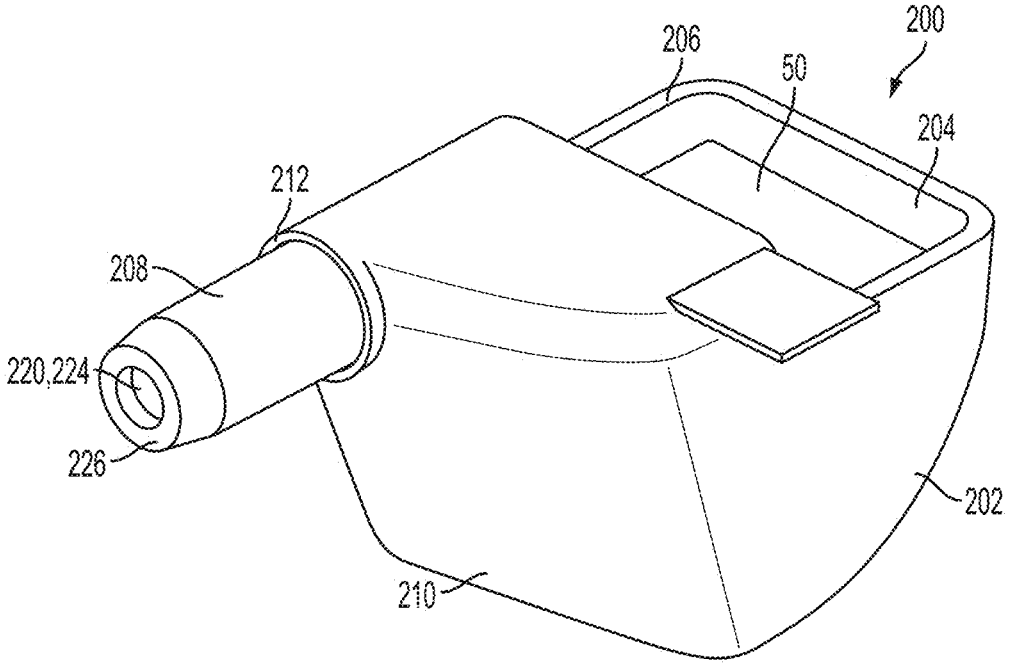
FIG. 4 shows a perspective view of a ladle comprising a filter according to an aspect of the present invention.

Referring next to FIGS. 3 and 4, a ladle 200 includes a main body 202, hollow interior 204, and an opening 206 for receiving molten metal 100. The opening 206 has a size that accommodates a dipping operation (such as into a crucible, dip well or related device) while permitting the ladle 200 to hold a sufficient quantity of the molten metal 100 in the hollow interior 204 during transport. For example, the opening 206 may be a substantially open top used for filling the hollow interior 204 with the molten metal 100. As a non-limiting example, the main body 202 may be in the form of a partial cylinder with capped ends. Other shapes for the main body 202 may also be used, as desired.

The main body 202 has a dispensing nozzle 208 formed therein. In one form, the dispensing nozzle 208 may be integral or non-reversibly attached with the sidewall 210 of the main body 202. In other forms, the sidewall 210 comprises a dispensing nozzle receptor 212 to which the dispensing nozzle 208 may be reversibly attached such as with a threaded connection. The dispensing nozzle 208 ranges from a minimum length of approximately 100 mm to a maximum length of approximately 350 mm. A funnel panel (not shown) may form part of the sidewall 210 of the portion of the main body 202 that is adjacent the dispensing nozzle 208 and may be used to help direct the molten metal 100 toward the dispensing nozzle 208 when the ladle 200 is rotated to orient the dispensing nozzle 208 downward. An orientation of the sidewall 210 may be such that it is angled downwardly when the main body 202 is rotated is rotated to orient the dispensing nozzle 208 downward.

The dispensing nozzle 208 further has a fluid metal filter 220 formed therein. The fluid metal filter 220 captures inclusions such as deleterious oxides transferred from the dip well bath allowing inclusion free molten metal 100 to pass through. In addition, the fluid metal filter 220 reduces the metal velocity exiting the dispensing nozzle 208, reducing the turbulence and oxide generation of the metal stream as it fills the shot sleeve.

In one form, the fluid metal filter 220 is a screen 222. In various embodiments the screen 222 is disposed proximal the exit face 226 of the dispensing nozzle 208. For example, the screen 222 may be placed at 70%, 80%, or 90% along the length of the dispensing nozzle 208 so as to be closer to the exit face 226 than the dispensing nozzle receptor 212. The length of the dispensing nozzle 208 being represented by the axis spanning from the attachment to the dispensing nozzle receptor 212 to the exit face 226. In further embodiments the screen 222 is disposed distal the exit face 226 of the dispensing nozzle 208. For example, the screen 222 may be placed at 10%, 20%, 30%, or 40% along the length of the dispensing nozzle 208 so as to be closer to the dispensing nozzle receptor 212 than the exit face 226. In yet further embodiments the screen 222 is disposed on or at the exit face 226 of the dispensing nozzle 208. In still yet further embodiments the screen 222 is disposed on or at the face of the dispensing nozzle 208 opposite the exit face 226 and near the dispensing nozzle receptor 212 of the dispensing nozzle 208.

The screen 222 is configured to capture inclusions such as deleterious oxides transferred from the dip well bath while allowing inclusion free molten metal 100 to pass through. In various embodiments the screen 222 comprises fiberglass. In further embodiments the screen 222 may comprise, for example, steel wire mesh, fiber ceramic cloth, or tinplate.

The mesh size of the screen 222 determines the minimum particle size of inclusions such as deleterious oxides transferred from the dip well bath which are captured. In various embodiments the screen comprises an approximately 16 to 20 mesh with approximately 1.1 to 0.9 mm width opening and an approximately 51 to 46% open area A non-limiting exemplary screen includes a 20 mesh screen with a width opening of 0.9 mm and an open area of approximately 46%. If the mesh size is too small flow of the inclusion free molten metal 100 is unnecessary constricted while a mesh which is too large allows deleterious inclusions to pass through In another form, the fluid metal filter 220 is a porous ceramic filter 224. In various embodiments the porous ceramic filter 224 is disposed proximal the exit face 226 of the dispensing nozzle 208. For example, the porous ceramic filter 224 may be placed at 60%, 70%, 80%, or 90% along the length of the dispensing nozzle 208 so as to be closer to the exit face 226 than the dispensing nozzle receptor 212. In further embodiments the porous ceramic filter 224 is disposed distal the exit face 226 of the dispensing nozzle 208. For example, the porous ceramic filter 224 may be placed at 10%, 20%, 30%, or 40% along the length of the dispensing nozzle 208 so as to be closer to the dispensing nozzle receptor 212 than the exit face 226. In yet further embodiments the porous ceramic filter 224 is disposed at the exit face 226 of the dispensing nozzle 208. In still yet further embodiments the porous ceramic filter 224 is disposed on or at the face of the dispensing nozzle 208 opposite the exit face 226 and near the dispensing nozzle receptor 212 of the dispensing nozzle 208.

The thickness of the porous ceramic filter 224 is represented by the dimension of the porous ceramic filter 224 extending along the length of the dispensing nozzle 208. In embodiments, the porous ceramic filter 224 has a thickness of approximately 22 mm. In further embodiments, the porous ceramic filter 224 has a thickness of approximately 12 mm. Additionally, one skilled in the art would appreciate that additional filter thickness are possible such as a porous ceramic filter 224 representing 10%, 20%, 30%, 40%, 50%, 60%, 70%, 80%, 90%, or 100% of the length of the dispensing nozzle 208.

The porous ceramic filter 224 is configured to capture inclusions such as deleterious oxides transferred from the dip well bath while allowing inclusion free molten metal 100 to pass through. Exemplary, non-limiting, ceramics for the porous ceramic filter 224 include mullite, alumina silicate and kyanate. In further embodiments the porous ceramic filter 224 may comprise, for example, phosphate bonded alumina.

The pore size of the porous ceramic filter 224 determines the minimum particle size of inclusions such as deleterious oxides transferred from the dip well bath which are captured. Non-limiting exemplary pore sizes include 10 pores per inch and 15 pores per inch porous ceramic filters. If the pore size is too small flow of the inclusion free molten metal 100 is unnecessary constricted while a pore size which is too large allows deleterious inclusions to pass through. The pore size selection of the porous ceramic filter 224 may be made to allow for a 6 pound/sec flow rate of molten metal 100 into the horizontal shot sleeve with no oxide films larger than 1×1 mm.

The porosity of the porous ceramic filter 224, in combination with pore size, determines the difficulty in passing the molten metal 100 through the porous ceramic filter 224. Porosity, also known as void fraction, is a measure of the void or "empty" spaces in a material, and is a fraction of the volume of voids over the total volume, between 0 and 1, or as a percentage between 0 and 100%. In general, with thickness and pore size being equal, the lower the porosity, the more resistance the molten metal 100 experiences passing through the porous ceramic filter 224. In this example, if the porosity is too low flow of the molten metal 100 is unnecessary constricted, while a porosity which is too large allows deleterious inclusions to pass through. The porous ceramic filter 224 captures inclusions such as deleterious oxides transferred from the dip well bath by obstructing their path and causing them to become captured in the cellular structure of the porous ceramic filter 224. By varying the thickness of the porous ceramic filter 224, one can enhance the ability for the inclusions to depth load and capture inclusions along the length of the porous ceramic filter 224 instead of merely face loading and blocking all inclusions from entering the porous ceramic filter 224 at all. In combination with the pore size, the porosity selection may be made to allow for a 6 pound/sec flow rate of molten metal 100 into the horizontal shot sleeve with no oxide films larger than 1×1 mm.

Figure 5A:
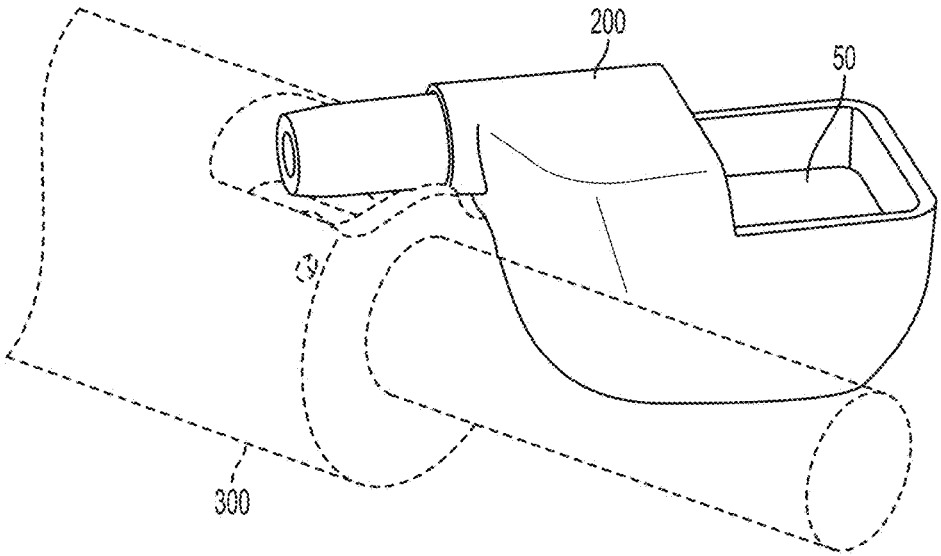
FIGS. 5A and 5B show sequential steps in delivering molten metal from the ladle of FIGS. 3 and 4 to a shot sleeve according to an aspect of the present invention.
Figure 5B:
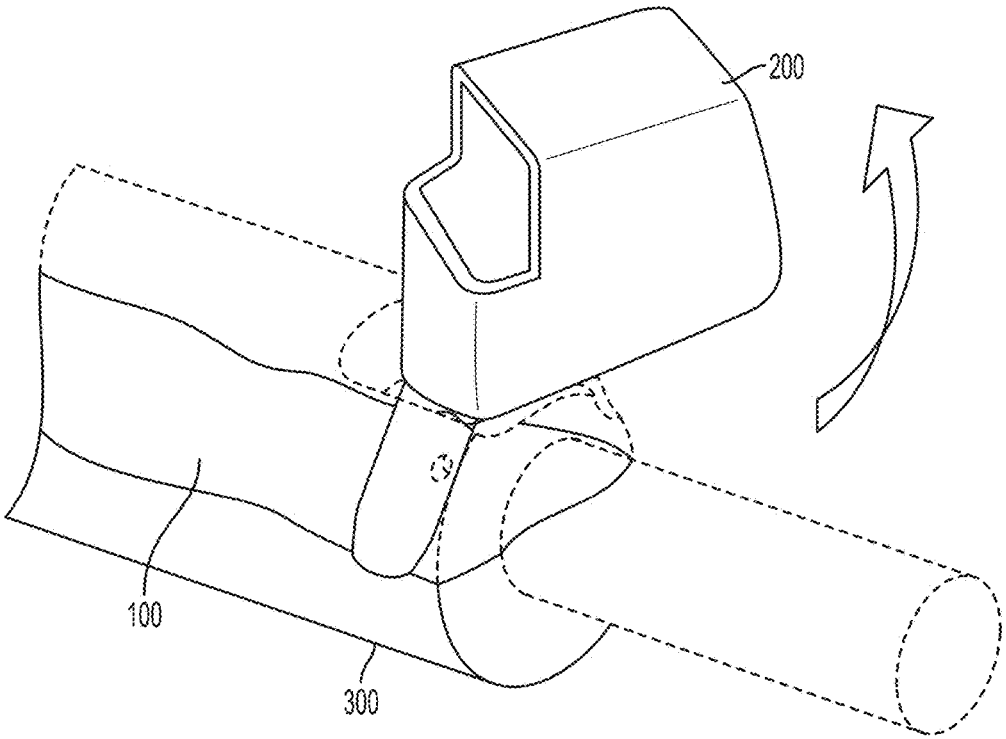

In operation, the fluid metal filter 220 and ladle configuration of FIGS. 3 and 4 is augmented by having the exit face 226 of the dispensing nozzle 208 extend to be proximal to the bottom of a receptacle 300 such as a shot sleeve, runner or related fluid-conveying receptacle. For clarity, the receptacle 300 is referred to as the shot sleeve 300 throughout this disclosure but other types of receptacles are equally envisioned. The exit face 226 of the dispensing nozzle 208 is extended proximal to the bottom of the shot sleeve 300 by rotating the ladle 200 about an axis extending transversely across the dispensing nozzle 208 with the exit face 226 of the dispensing nozzle 208 disposed over a fill opening of the shot sleeve 300. The rotation of the ladle 200 is illustrated in FIGS. 5A and 5B.

By placing the exit face 226 of the dispensing nozzle 208 proximal the bottom of the shot sleeve 300, the delivery of the molten metal 100 from the dispensing nozzle 208 to the shot sleeve 300 takes place with a minimal unimpeded drop as a way to reduce the turbulent effects of a conventional vertical delivery. Such an arrangement promotes low velocity molten metal 100 delivery. Thus, using the present approach, the molten metal 100 may be contact poured at the lowest point of the shot sleeve 300 and then have a greatly reduced amount of turbulence in the molten metal from ladle 200 in entering the confined environment of the shot sleeve 300. Specifically, extending the exit face 226 of the dispensing nozzle 208 toward the bottom of the shot sleeve 300 allows a bottom fill system; significantly, the recommended metal fill velocity is kept very low in the present system (preferably below 0.5 m/s for most aluminum-based alloys).

The ladle 200 is compatible with many existing dip well furnace and ladler equipment. For example, robotic manipulation of the ladle 200 is achievable in the same manner as present systems. Significantly, the pouring efficiency of a conventional tilt ladle pour process is preserved while minimizing the formation of turbulence of the molten metal 100 during introduction into the shot sleeve 300, as well as removal of inclusions transferred from the dip well bath. Importantly, the method of the present invention also reduces initial metal stream surface area and oxide film formation.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. Moreover, the term "substantially" is utilized herein to represent the inherent degree of uncertainty that may be attributed to any quantitative comparison, value, measurement, or other representation. As such, it may represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of transferring molten metal to a die casting mold, the method comprising:

providing a ladle with a dip well and a dispensing nozzle formed therein, wherein said dispensing nozzle is removable from a dispensing nozzle receptor formed on said ladle;

providing a receptacle fluidly between said ladle and said mold;

delivering said molten metal from said ladle to said receptacle by positioning an exit face of said dispensing nozzle over said receptacle and rotating said ladle such that said exit face of said dispensing nozzle is repositioned proximal the bottom of said receptacle; and conveying said molten metal that has been delivered to said receptacle into a mold cavity that is placed in fluid communication therewith, wherein said dispensing nozzle comprises a fluid metal filter formed therein.

2. The method of claim 1, wherein said receptacle is a shot sleeve.

3. The method of claim 1, wherein the method further comprises affixing said dispensing nozzle to said dispensing nozzle receptor.

4. The method of claim 1, wherein said fluid metal filter is a porous ceramic filter disposed within the length of said dispensing nozzle.

5. The method of claim 4, wherein said ceramic filter is configured to allow for a 6 pound/sec flow rate of molten metal into said receptacle with no oxide films larger than 1×1 mm.

6. The method of claim 1, wherein said fluid metal filter is a screen comprising a refractory material disposed proximal said exit face of said dispensing nozzle.

7. The method of claim 6 wherein said screen is disposed on said exit face of said dispensing nozzle.

8. The method of claim 6, wherein said screen comprises a mesh opening of approximately 0.9 mm to approximately 1.1 mm.

9. The method of claim 6, wherein said refractory material is fiberglass.

10. The method of claim 1, wherein said dispensing nozzle and said dip well are disposed on opposite sides of said ladle.

11. The method of claim 1, wherein said exit face of said dispensing nozzle reaches the bottom of said receptacle upon rotating said ladle.

12. The method of claim 6, wherein said exit face of said dispensing nozzle is contoured to substantially match the bottom of the receptacle.

13. The method of claim 1, wherein rotation of said ladle is robotically controlled.

14. A method of transferring molten metal to a die casting mold, the method comprising:

providing a ladle with a dip well and a dispensing nozzle receptor formed on opposite sides of said ladle, affixing a dispensing nozzle to said dispensing nozzle receptor;

providing a receptacle fluidly between said ladle and said mold;

collecting said molten metal in said ladle;

delivering said molten metal from said ladle to said receptacle by positioning an exit face of said dispensing nozzle over said receptacle and rotating said ladle such that said exit face of said dispensing nozzle is repositioned proximal the bottom of said receptacle; and conveying said molten metal that has been delivered to said receptacle into a mold cavity that is placed in fluid communication therewith, wherein said dispensing nozzle comprises a fluid metal filter formed therein and said receptacle is a horizontal shot sleeve.

15. The method of claim 14, wherein said exit face of said dispensing nozzle reaches the bottom of said receptacle upon rotating said ladle.

16. The method of claim 15, wherein said exit face of said dispensing nozzle is contoured to substantially match the bottom of the receptacle.

17. The method of claim 14, wherein said fluid metal filter is a porous ceramic filter disposed within the length of said dispensing nozzle.

18. The method of claim 17, wherein said ceramic filter is configured to allow for a 6 pound/sec flow rate of molten metal into said receptacle with no oxide films larger than 1×1 mm.

19. The method of claim 14, wherein said fluid metal filter is a screen comprising a refractory material disposed proximal said exit face of said dispensing nozzle.

* * * * *